US010329734B2

(12) United States Patent
Garcia-Huidobro Valdivieso

(10) Patent No.: US 10,329,734 B2
(45) Date of Patent: Jun. 25, 2019

(54) BUCKET FOR A ROPE SHOVEL

(71) Applicant: Ansar Diseno Limitada, Talagante (CL)

(72) Inventor: Alfredo Garcia-Huidobro Valdivieso, Talagante (CL)

(73) Assignee: Ansar Diseno Limitada, Talagante (CL)

( * ) Notice: Subject to any disclaimer, the term of this patent is extended or adjusted under 35 U.S.C. 154(b) by 331 days.

(21) Appl. No.: 15/320,770

(22) PCT Filed: Jun. 24, 2015

(86) PCT No.: PCT/IB2015/054751

§ 371 (c)(1),
(2) Date: Dec. 21, 2016

(87) PCT Pub. No.: WO2015/198248

PCT Pub. Date: Dec. 30, 2015

(65) Prior Publication Data

US 2017/0218596 A1 Aug. 3, 2017

(30) Foreign Application Priority Data

Jun. 26, 2014 (CL) ..... 1727-2014

(51) Int. Cl.
*E02F 3/60* (2006.01)
*E02F 3/40* (2006.01)
(Continued)

(52) U.S. Cl.
CPC ..... *E02F 3/60* (2013.01); *E02F 3/308* (2013.01); *E02F 3/40* (2013.01); *E02F 9/2883* (2013.01)

(58) Field of Classification Search
CPC ..... E02F 3/141; E02F 3/40; E02F 3/60
(Continued)

(56) References Cited

U.S. PATENT DOCUMENTS 747,719 A * 12/1903 Hunt et al. ..... E02F 3/141 37/339
1,419,524 A * 6/1922 Seyms ..... E02F 3/141 37/339

(Continued)

FOREIGN PATENT DOCUMENTS

WO WO 2015/198248 12/2015

OTHER PUBLICATIONS

International Search Report (ISR) and Written Opinion of International Searching Authority, PCT/IB2015/054751 dated Oct. 21, 2015.

*Primary Examiner* — Gary S Hartmann
(74) *Attorney, Agent, or Firm* — Tolpin & Partners, PC; Thomas W. Tolpin

(57) ABSTRACT

An bucket for a rope shovel provides a structure which is resistant to great mechanical forces and stress during operation of the bucket. The bucket comprises a tubular body (11) with an interior having a closed curvature (8). The tubular body (11) is formed by at least one plate (4) which is folded until its ends are butted and has weld beads (9*a*, 9*b*, 9*c*) and/or weld plugs (9*c*) to form the body (11) with a tubular shape. The tubular body (11) has an exterior with reinforcement layers (12, 13, 14, 15) comprising at least a plate (4). The lower front portion of the tubular body (11) has a lip (25) which is formed sheets (25*a*, 25*b*, 25*c*, 25*d*) that are overlapped and nested. Each sheet is formed by at least one plate (4). The upper portion of the tubular body (11) has engagement supports (20, 21, 22 which are also made of at least one plate (4).

18 Claims, 19 Drawing Sheets

(51) Int. Cl.
*E02F 9/28* (2006.01)
*E02F 3/30* (2006.01)

(58) Field of Classification Search
USPC ..... 37/339, 341, 379, 398
See application file for complete search history.

(56) References Cited

U.S. PATENT DOCUMENTS

| | | | | |
|---|---|---|---|---|
| 1,421,346 | A | 6/1922 | Seyms | |
| 1,479,340 | A | 1/1924 | Trainor | |
| 1,539,863 | A | 6/1925 | Pemberton | |
| 1,582,577 | A | 4/1926 | Crane | |
| 1,717,907 | A | 6/1929 | Anderson | |
| 1,757,328 | A | 5/1930 | Mullally | |
| 1,963,847 | A | 6/1934 | Jersey | |
| 1,984,322 | A | 12/1934 | Stires | |
| 2,091,974 | A | 9/1937 | Fykse | |
| 2,243,965 | A | 6/1941 | Larsen | |
| 2,561,518 | A | 7/1951 | Larsen | |
| 2,584,416 | A | 2/1952 | Boehringer | |
| 3,107,445 | A | 10/1963 | Ratkowski | |
| 3,402,486 | A | 9/1968 | Branson | |
| 4,251,933 | A | 5/1981 | Hemphill | |
| 4,443,957 | A | 5/1984 | Novotny | |
| 4,517,756 | A | 5/1985 | Olds | |
| 4,939,855 | A | 7/1990 | McCreary | |
| 5,063,694 | A | 11/1991 | McCreary | |
| 6,990,760 | B1 | 1/2006 | Zaayman | |
| 7,096,610 | B1 | 8/2006 | Gilmore | |
| 7,681,689 | B2 * | 3/2010 | Imamura | E02F 3/40 181/207 |
| 7,743,881 | B2 * | 6/2010 | Imamura | E02F 3/40 181/207 |
| 8,438,759 | B2 * | 5/2013 | Imamura | E02F 3/40 37/444 |
| 9,272,652 | B2 * | 3/2016 | Garcia-Huidobro Valdivieso | B60P 1/286 |
| 9,670,643 | B2 * | 6/2017 | Caux | E02F 3/40 |
| 10,024,028 | B2 * | 7/2018 | Flores | E02F 3/4075 |
| 10,161,103 | B2 * | 12/2018 | Falkenhagen | E02F 3/60 |
| 2012/0279095 | A1 | 11/2012 | Feld | |
| 2013/0136570 | A1 | 5/2013 | Colwell | |
| 2013/0192099 | A1 | 8/2013 | Gilmore | |
| 2014/0165431 | A1 | 6/2014 | Bienfang | |
| 2017/0350089 | A1 * | 12/2017 | Hren | E02F 3/48 |

* cited by examiner

BUCKET FOR A ROPE SHOVEL

TECHNICAL FIELD OF THE INVENTION

The present invention relates to a bucket or main body of a bucket for an excavator shovel, for instance, a rope shovel (dipper) wherein said bucket is built by aggregation of layers of laminated plates of high resistance also with respect to the wear, which are joined to each other by means of welding in order to achieve greater thicknesses as well as the connection among different parts, so as by means of a sole type of material as for example, a plurality of plates a highly resistant structure to mechanical efforts which the assembly is subjected to during its operation is achieved.

The bucket for a mining rope shovel is simplified and restricted regarding its manufacture methods and materials.

The bucket for a rope shovel of this invention is solely built with at least one laminated steel plate, dispensing with the intensive use of wrought and cast materials.

BACKGROUND OF THE INVENTION

Rope shovels dated from the end of XIX century (steam shovels) have evolved wherein the assembly of the equipment and all of the respective components thereof have steadily increased in size and capacities over time.

Thus, those buckets which in its early stages were built by means of riveting led to welded components thereby allowing to increase its capabilities.

Then, when the dimensions thereof increased significantly there was a forced use of more resistant components having greater thicknesses which at present are obtained by means of hot casting and forging processes.

Even though current buckets include the use of metal plates, these are used in places where the structure is lighter and also as coatings which are resistant to wear.

Nowadays, the use of metal plates is not an alternative for building the whole assembly, since the cast and wrought pieces which are the ones dominating and providing the structural resistance have a greater importance.

Considering the mechanical stresses which these components are subjected to, some of them being wrought and others cast, it becomes necessary to have more complex alloys which in its composition can include several expensive components such as nickel and manganese just to name of few.

The manufacturing processes of these components are also complex.

On the one hand, they require relatively developed technologies in order to keep the manufacture of big pieces under control, which have demanding specifications with regard to its mechanical stresses and on the other hand big non serial individual pieces, involving large amounts of energy which is comparatively artisanal in contrast to the laminating process of plates, are obtained.

From an industrial and economic point of view these mining buckets of a large size are like a "technological craft" which is limited to a few manufacturers having the appropriate installations in order to produce them, wherein the offer is relatively limited and the delivery times of said equipment are very long and very expensive.

In order to better understand the aforementioned it is possible to compare a typical big bucket whose weight is approximately 100 metric tons and with a price in the market of around US 2500, that is, a component of a value of US 25 per kilogram of steel, built as a bucket, versus laminated plates having a high mechanical resistance and also to wear which are commercialize per kilogram for less than one tenth of the calculated value for the kilogram of a bucket.

For any skilled person in the art of metal mechanical manufacture it will result obvious that if someone can obtain an equivalent equipment, mainly built by means of metal plates, said person will have to face a shift paradigm or quantum leap at least with respect to the costs in manufacturing the same.

In the state of the art there are several documents disclosing buckets which have been built by means of casting and forging.

Thus, for instance, document US 2013136570 discloses a bail for a rope shovel having a hoist rope and a dipper. The bail includes a pair of arms coupled to the dipper; and a cross-member extending between the pair of arms and being pivotably coupled to each of the arms. The bail having a cross-member which includes a mounting block for coupling the hoist rope to said bail.

Document US 2012279095 discloses a dipper having an inlet and an outlet, and an inlet reference plane being defined at the inlet. The dipper includes a front wall and an opposite back wall extending between the inlet and the outlet.

A front wall reference plane extends from the inlet to the outlet and is positioned between the front wall and the back wall.

The dipper further includes two side walls connected between the front wall and the back wall and extending between the inlet and the outlet.

The inlet has an inlet area in the inlet reference plane, wherein the outlet has an outlet area in an outlet reference plane substantially parallel to the inlet reference plane.

The front wall, the back wall, and the two side walls are arranged such that the outlet area is at least 3 percent and no more than 25 percent greater than the inlet area.

Document U.S. Pat. No. 7,096,610 discloses a dipper assembly which includes a dipper, a dipper door, and a closure mechanism. The dipper door is pivotally linked relative to the dipper, and has a closed position in which the dipper door closes the open bottom. The closure mechanism has a lock position and an unlock position, and is fixed relative to the dipper and linked to the dipper door. In the lock position, the closure mechanism holds the dipper door in the closed position. In the unlock position, the closure mechanism allows the dipper door to swing away from the closed position.

Document U.S. Pat. No. 5,063,694 discloses an excavating dipper for use with power shovels, draglines and the like that is fabricated from steel plate and is formed to have a separable bottom body member, which may be replaced when worn.

The dipper is of lightweight steel plate construction fabricated into substantially all welded top and bottom body members.

The plate members forming the side and bottom walls of the bottom body member are reinforced by longitudinal and transverse girth ribs.

Document U.S. Pat. No. 4,939,855 discloses an excavating dipper or bucket for a power shovel formed by an upper bucket portion having support brackets and the strength to support the rated load of the dipper and a disposable lower portion having opposed sidewalls and a bottom wall of a material thickness less than the upper sidewalls and top wall.

The lower sidewalls are secured to the upper sidewalls by interference fitted retaining pins disposed in machined bores formed in the upper sidewalls and the lower sidewalls, respectively.

The upper sidewalls may be modified to provide spaced-apart plate members which define a slot for receiving the lower sidewall portions, respectively.

Other documents showing different types of buckets are disclosed in documents U.S. Pat. Nos. 4,517,756; 4,251,933; 4,443,957; 3,402,486; 3,107,445; 2,584,416; 2,561,518; 2,243,965 U.S. Pat. Nos. 1,984,322; 1,757,328; 1,717,907; 1,582,577; 1,539,863; 1,479,340 which are hereby incorporated as reference.

Most of said buckets are manufactured by means of hot casting or forging processes.

However, for instance, document U.S. Pat. No. 2,243,965 discloses a dipper dated from 1940 in which the side and back walls are formed by a bent single plate and the rest of the components are built by the traditional casting and forging methods.

However, this dipper is not able to lift large loads which nowadays are moved in great mining.

Due to the aforementioned, the first objective of the present invention is providing a bucket for a rope shovel solely built by means of laminated steel plates.

A second objective of the present invention is providing components for said bucket, solely built by a plurality of plates where manufacturing costs and times are considerably reduced.

A third objective of the present invention is providing a bucket built by means of cold forming of multiples cylinder plates constituting wide curves where sharp edges are avoided since they cause stress concentration.

A fourth objective of the present invention is providing a bucket which, by virtue of its tubular construction avoids the confluence of welded connections of more than two plates or parts in a same corner, wherein said connections can be distributed in such a way that more than two plates cannot converge in a same place.

A fifth objective of the present invention is providing a bucket which, by virtue of its tubular construction, it simplifies the parts thereof, thereby reducing the quantity of complex welded connections.

SUMMARY OF THE INVENTION

The present invention relates to a bucket whose main body is formed by a cylinder plate as a tube which can be made of a sole or more plates to cover the perimeter.

To this main cylinder body are incorporated plates which are also cylinder plates in order to increase the thickness of the assembly where this is required thereby increasing its resistance to flexion.

These plate sheets attached to one another, are connected to each other by means of welding such as perimeter weld, plug weld or a combination thereof.

Also these layers of plates can be attached by riveting or bolting if the specific design of a determined application requires so.

The tubular body includes in its construction the lip made of the same plate or layers of plates.

Similarly, the reinforcement of the back perimeter against which the closure is closed is obtained from plates.

In this back perimeter, in turn, together with the same plate or layers of plates is made the closing portion or orifice for the cover latch.

The upper structures of the assembly including the bores for connecting the bucket with the shovel boom as well as the bores for mounting the cover are made by means of a thick laminated plate or aggregation of welded plates in the same way as the main pipe is made.

The reinforcements in the whole inner and outer perimeter of the mentioned body are also made with sections of the same plate.

The assembly of the body and front lip as previously mentioned are made of plates, including bores which allow attaching the replaceable teeth (gets) also desirably built from thick laminated plates.

BRIEF DESCRIPTION OF DRAWINGS

The attached drawings are included in order to show the preferred embodiments as well as the principles of the invention.

DESCRIPTION OF THE INVENTION

The present invention relates to a bucket for an excavator shovel, for instance, an electric rope shovel, which is formed by components made of at least one laminated steel plate. The basic concept of the present invention is explained based on FIGS. 1 to 4*c*.

Figure 1:
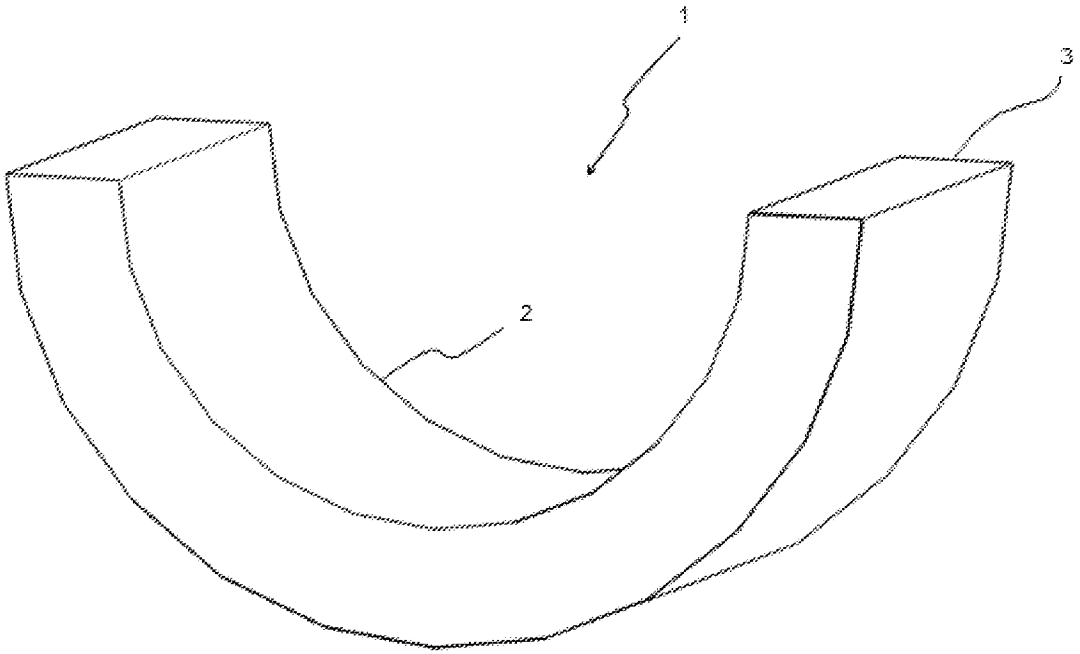
FIG. 1 shows a perspective view of a hot cast or forged piece.
Figure 2:
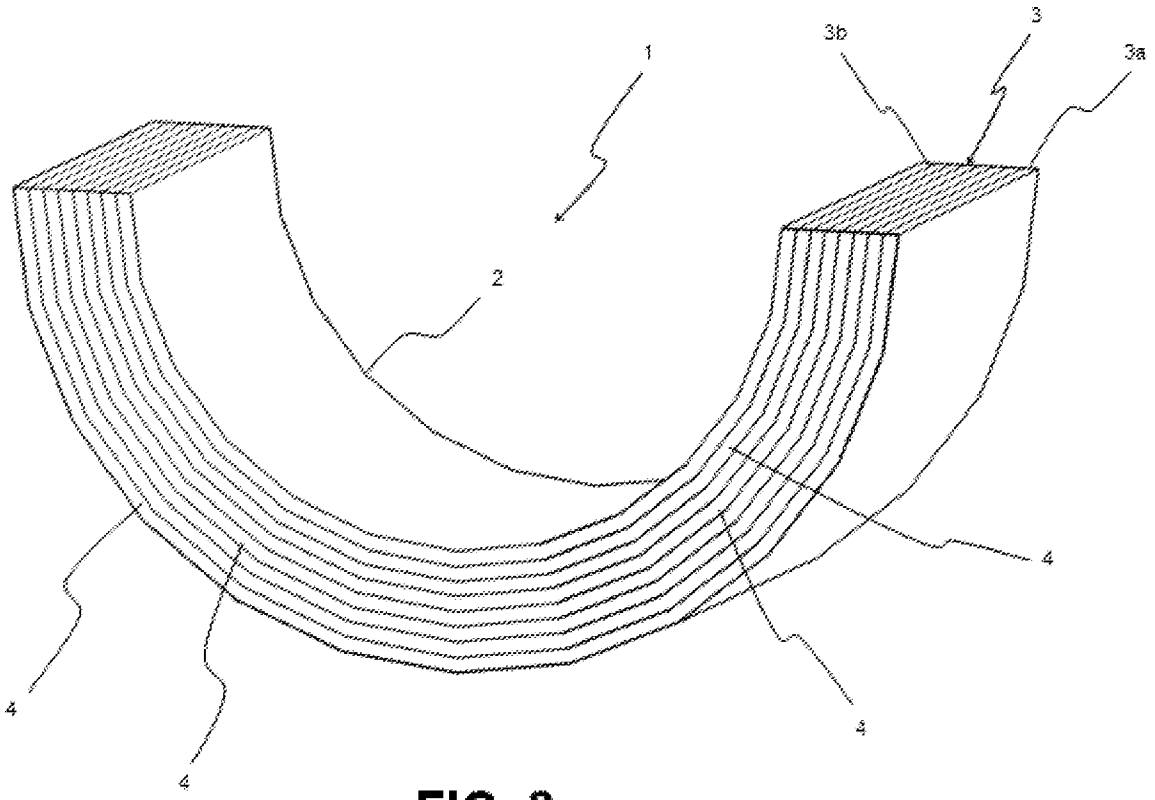
FIG. 2 shows a perspective view of the same piece showed in FIG. 1 but built from a plurality of plates.
Figure 3:
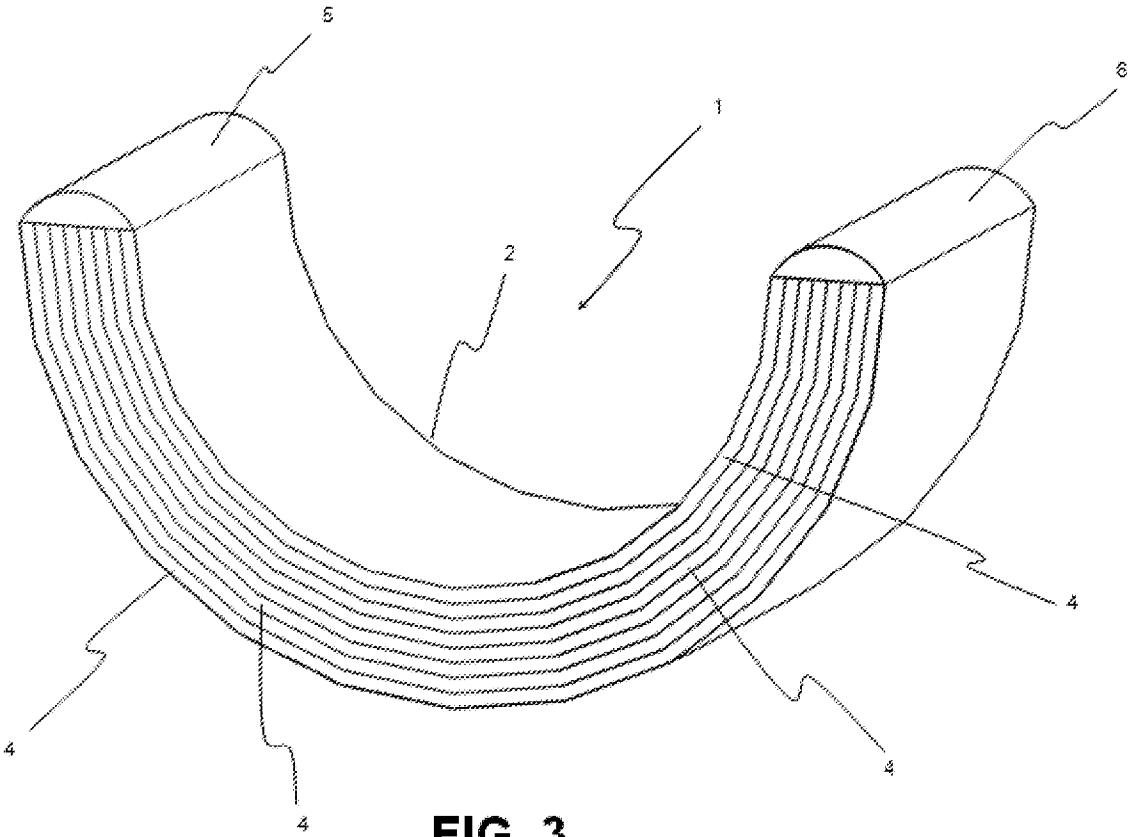
FIG. 3 shows a perspective view of FIG. 2 wherein the piece has weld beads so as to connect the plates.

FIG. 1 shows a piece (1) having an open curvature (2) and a thickness (3). If said thickness (3) is of a large dimension, for instance, in the order of 6 inches (15.2 cm), said piece (1) needs to be manufactured by hot casting or forging.

However, if said thickness (3) is divided into a plurality of small thicknesses (3*a*, 3*b*), for instance, of 1 inch (2.54 cm) each, then it is possible to form the piece (1) by means of cold bending of a plurality of plates (4) keeping the same open curvature (2) which is the case of this example would be six plates.

In order to produce a solid assembly of plates (4) it will be necessary to apply weld beads (5, 6).

Figure 4A:
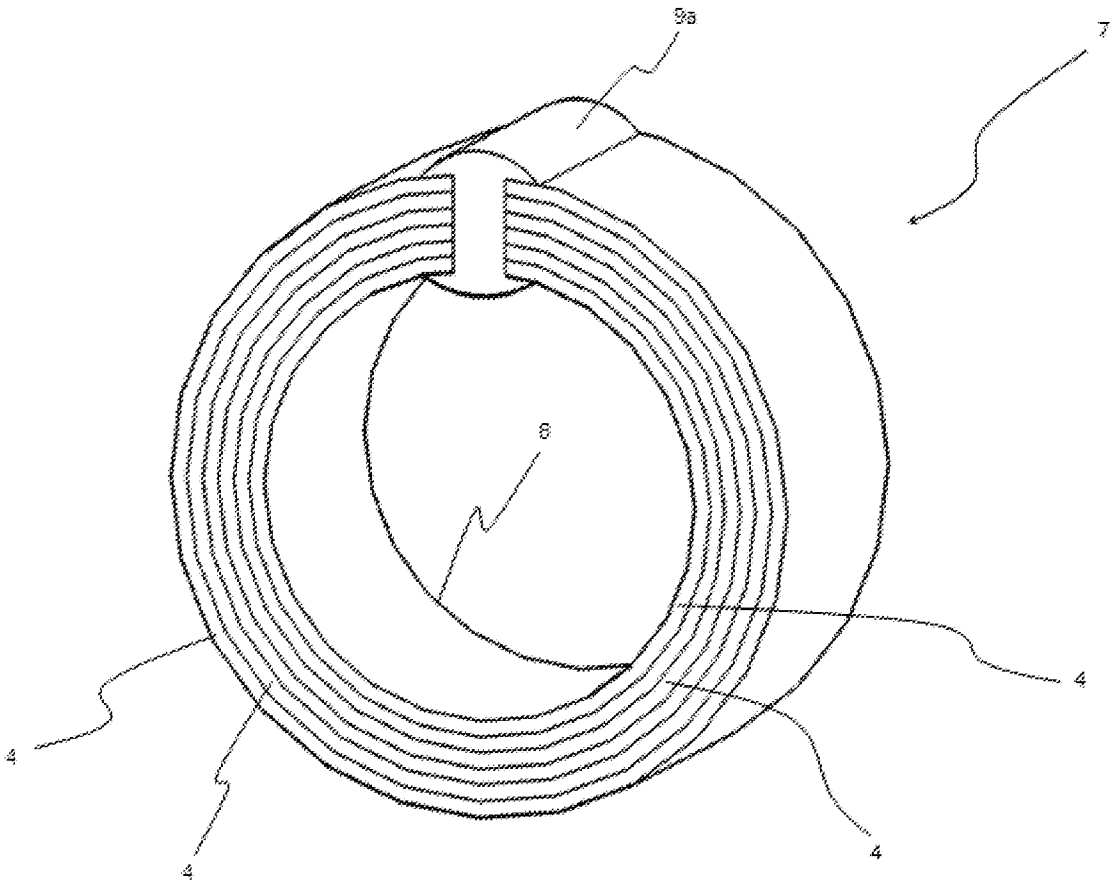
FIG. 4*a* shows a perspective view of a piece formed by plurality of butt-bent plates which explains the basic principles of the present invention.
Figure 4B:
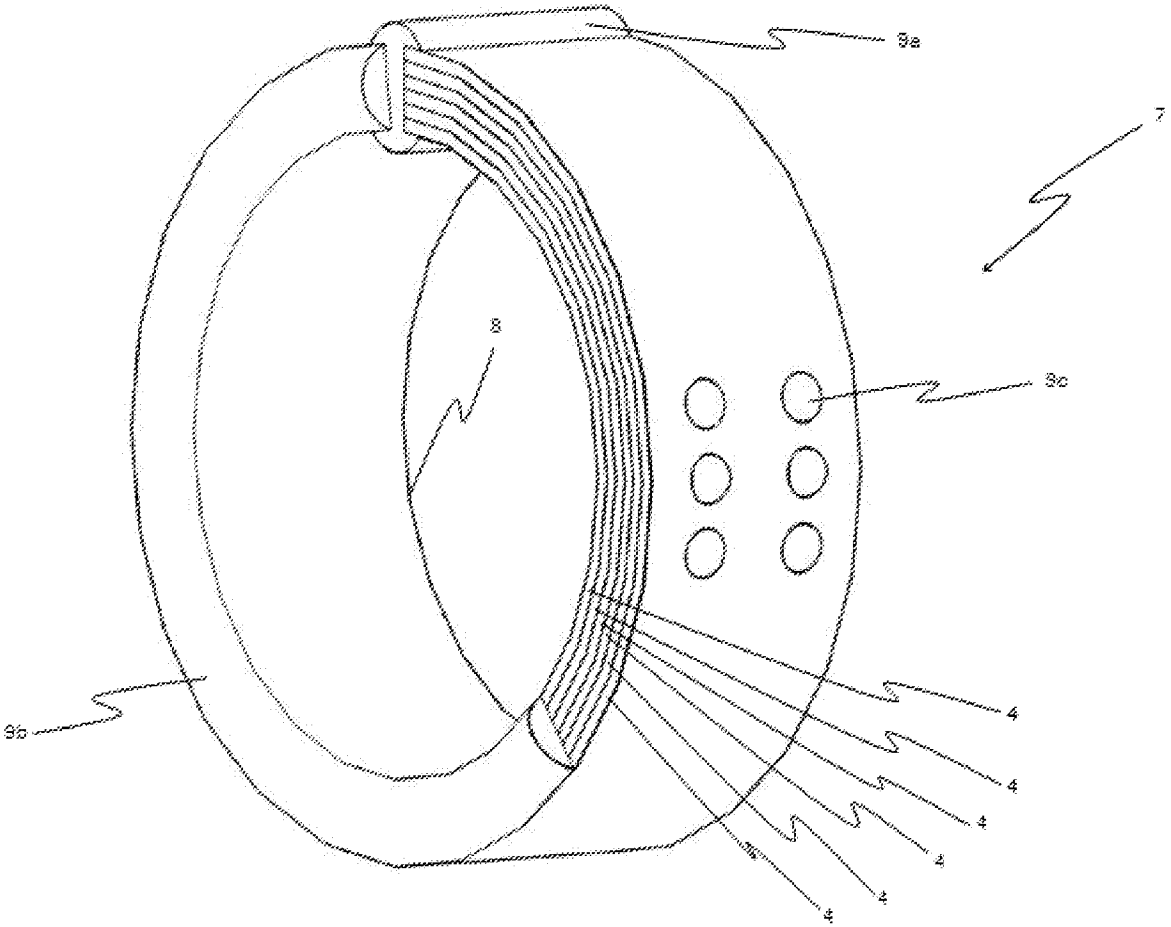
FIG. 4*b* shows a perspective view of a piece formed by a plurality of butt-bent plates, with the weld plugs and weld beads, explaining the basic principles of the present invention.

According to FIGS. 4*a* and 4*b*, a more resistant piece (7) can be manufactured if the folding thereof is continuous and the plurality of plates (4) has butted ends, thereby generating a closed curvature (8) which means that it would be required a weld bead of an upper joint (9*a*), a perimeter weld bead (9*b*) and when necessary, weld plugs (9*c*) which are required in order to increase the resistance of the assembly.

Figure 4C:
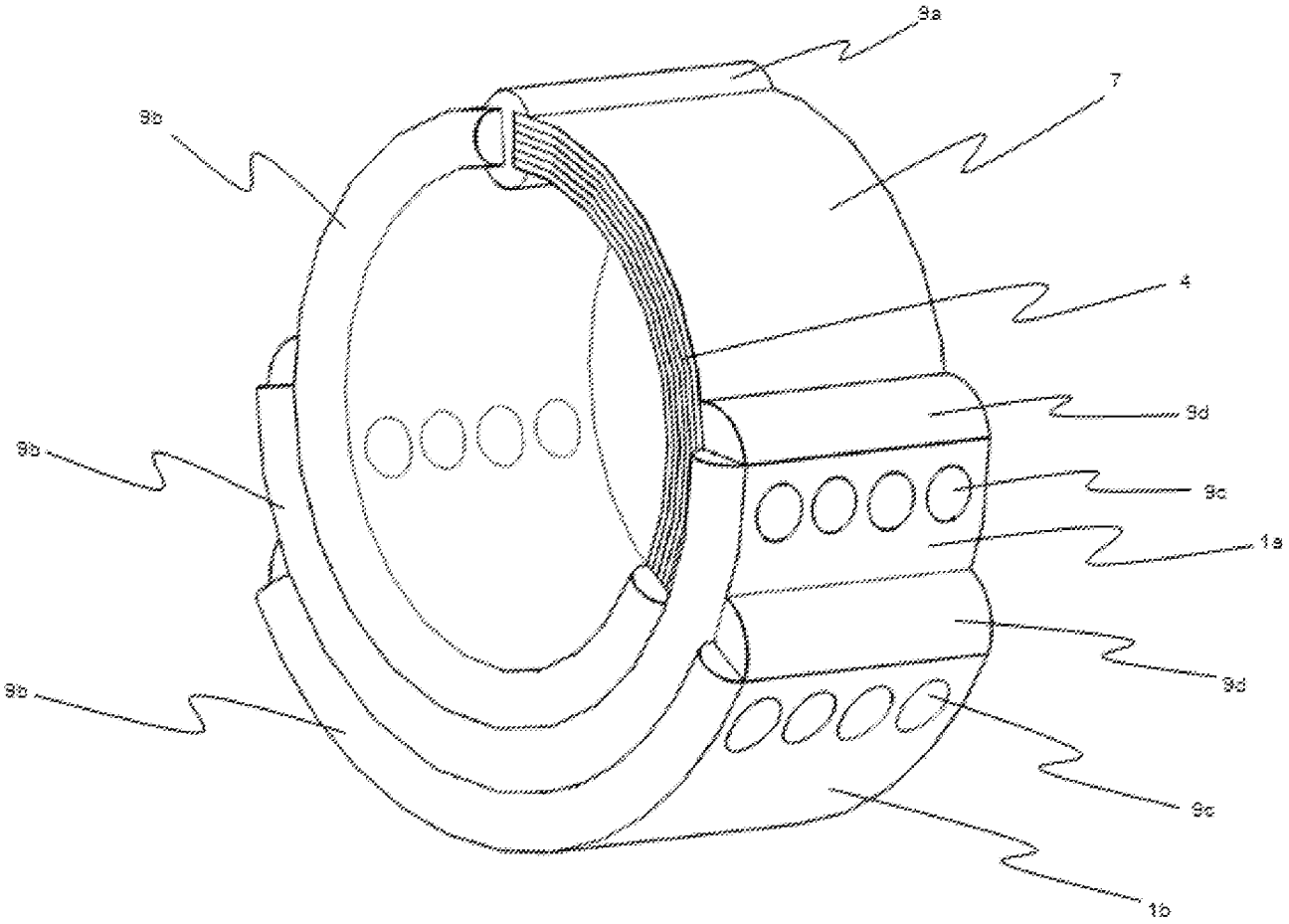
FIG. 4*c* shows a perspective view of a piece formed by a plurality of butt-bent plates, with weld plugs and weld beads, explaining the basic principles of the present invention.
Figure 5:
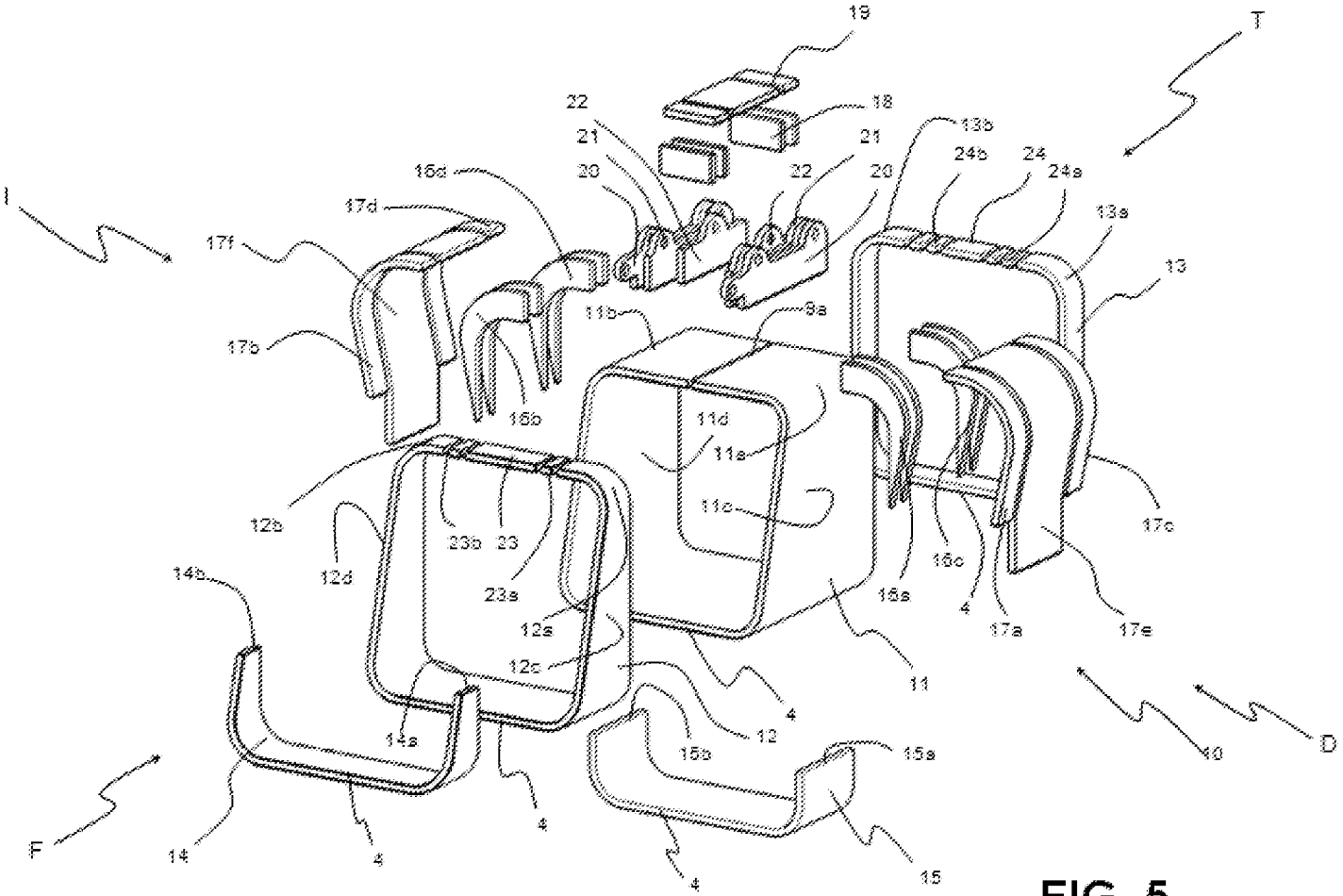
FIG. 5 shows a front exploded perspective view of the components of a first embodiment of the bucket of the present invention wherein the "F" letter represents the front view, "T" the rear view; "D" the right view: and "I" the left view.
Figure 6:
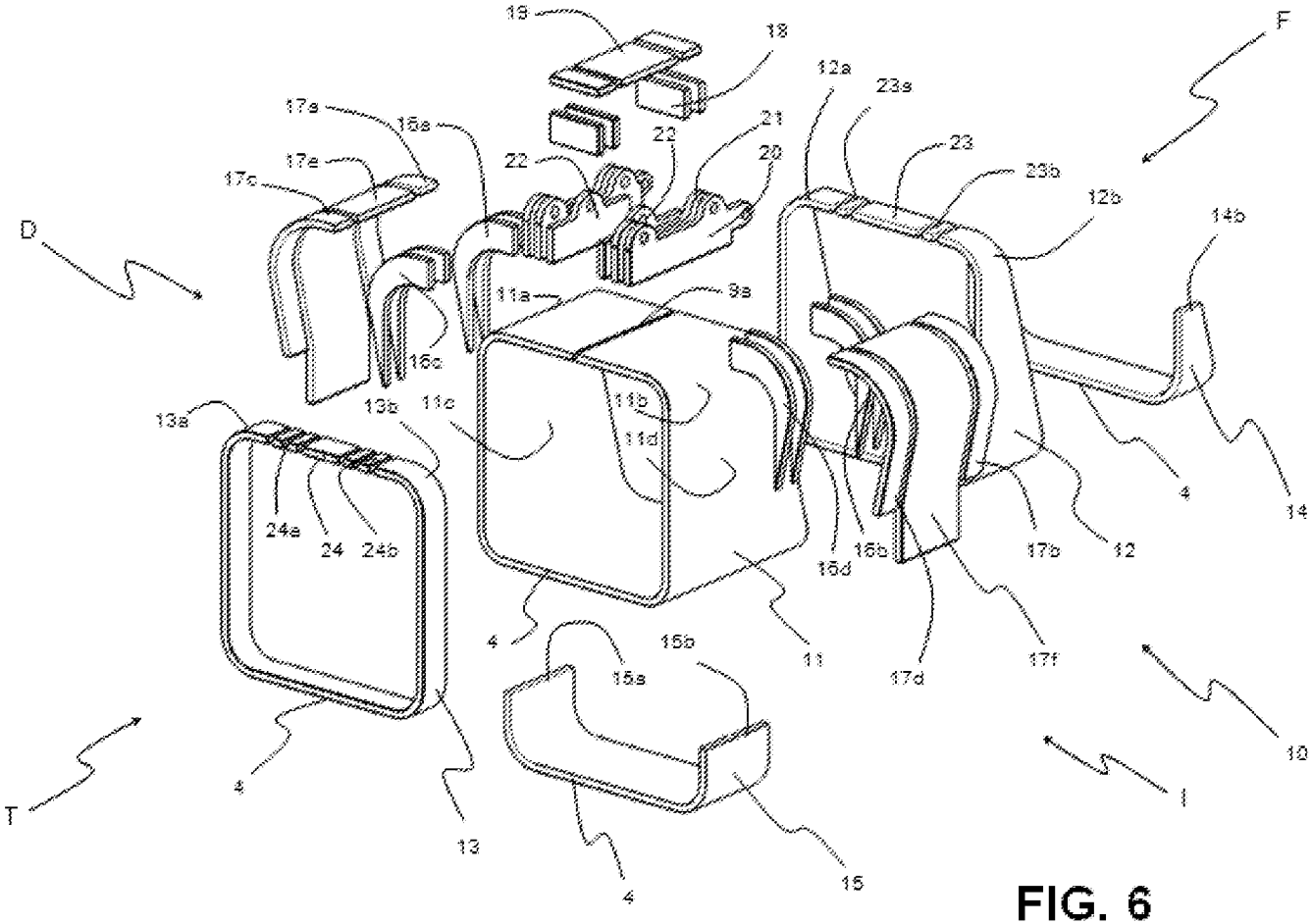
FIG. 6 shows a back exploded perspective view of the components of a first embodiment of the bucket of the present invention wherein the "F" letter represents the front view, "T" the rear view; "D" the right view: and "I" the left view.
Figure 7:
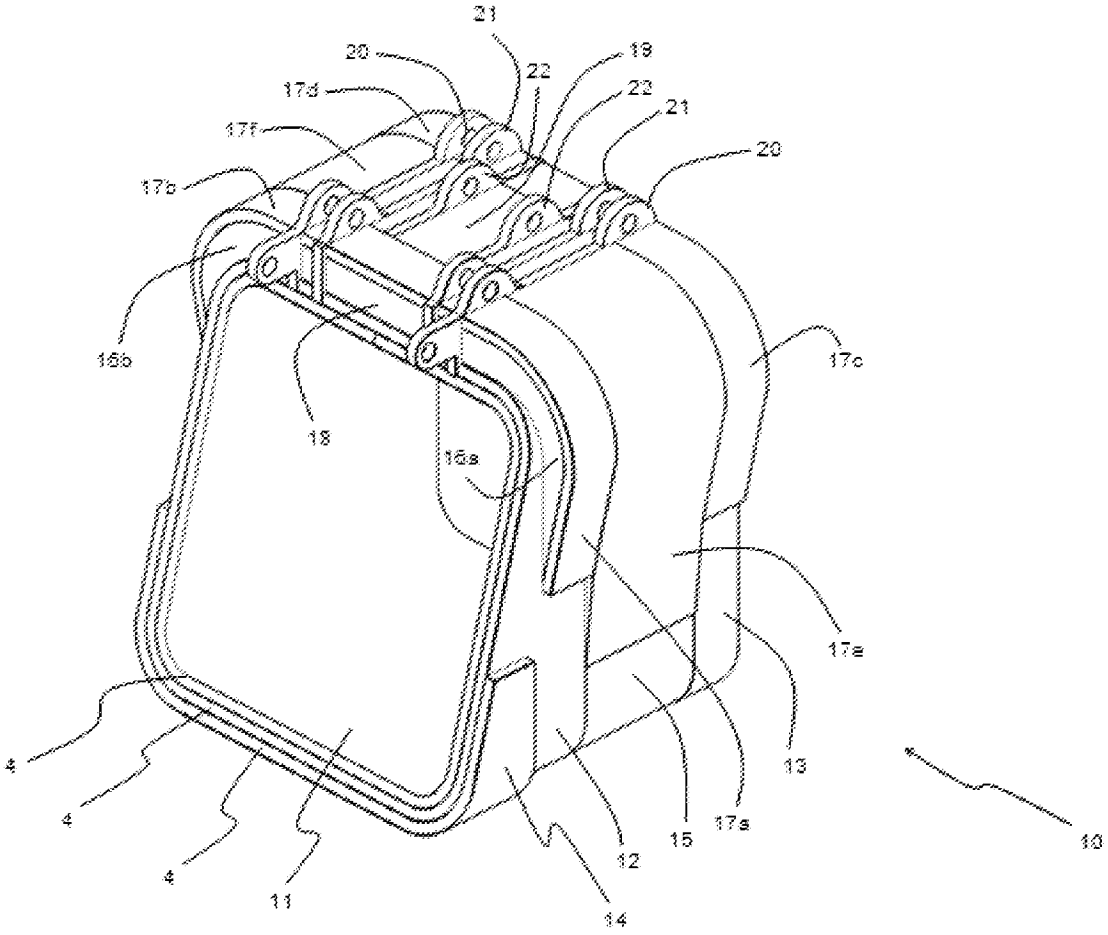
FIG. 7 shows a perspective view of a first embodiment of a bucket of the present invention.
Figure 8:
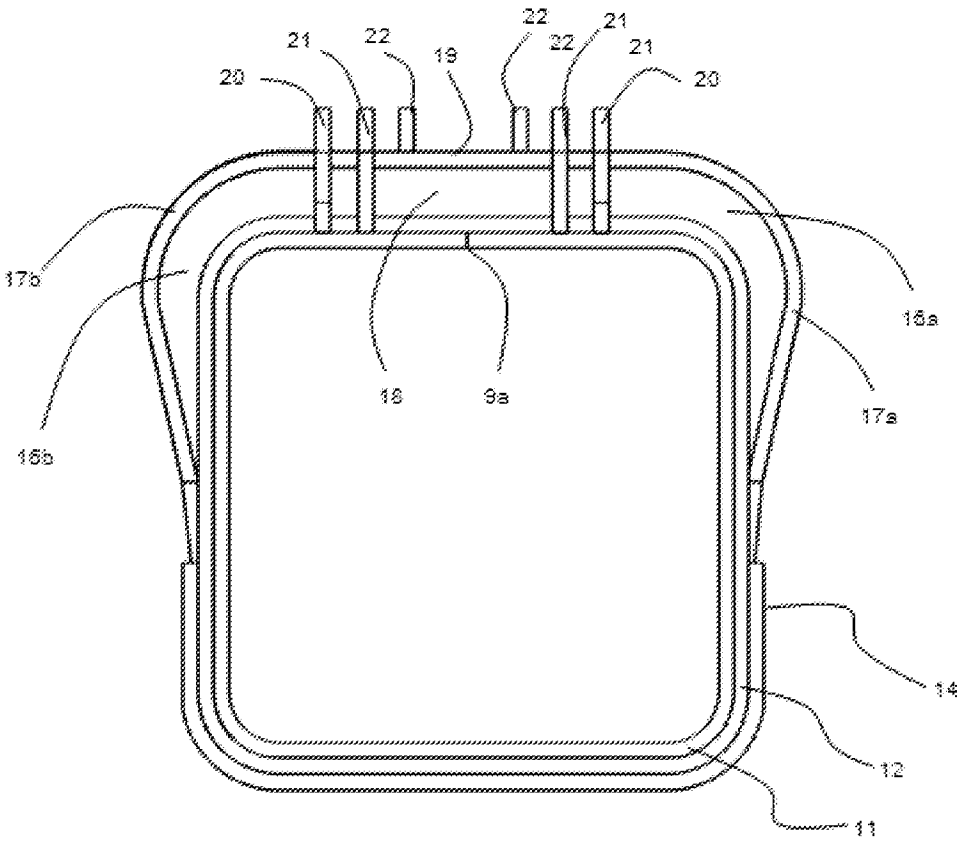
FIG. 8 shows an elevation front view of a first embodiment of a bucket of the present invention.
Figure 9:
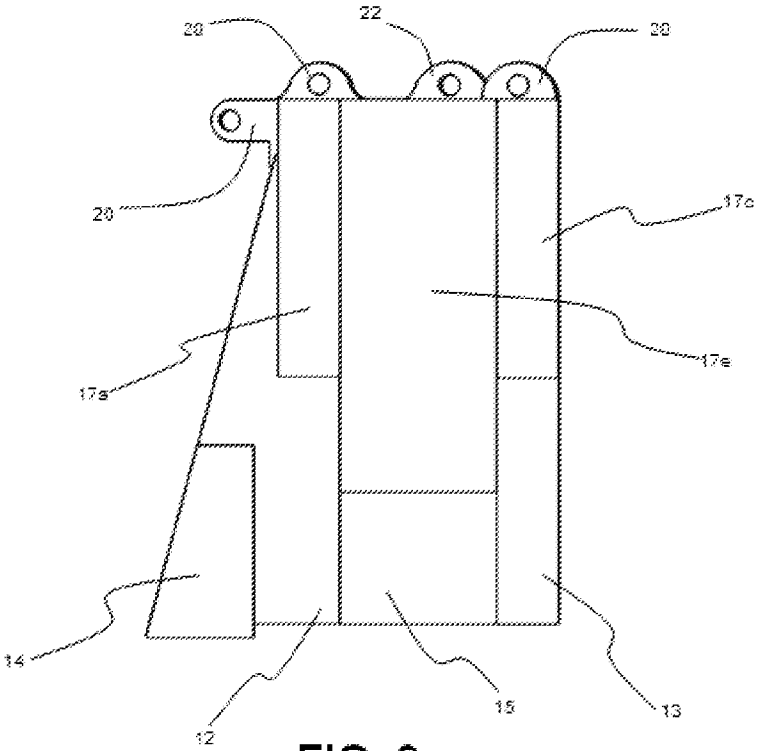
FIG. 9 shows a side view of a first embodiment of a bucket of the present invention.
Figure 10:
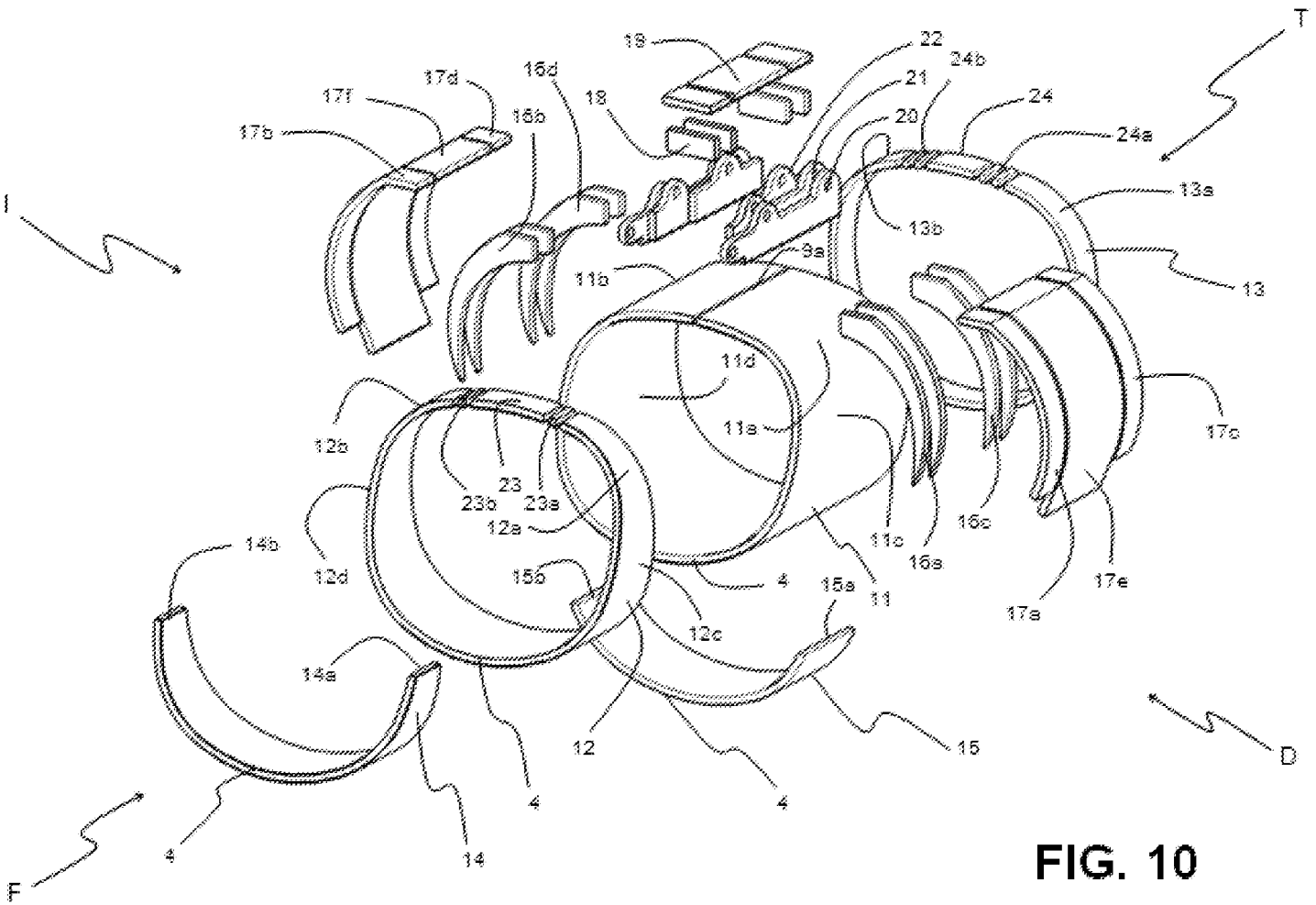
FIG. 10 shows a front exploded perspective view of the components of a second embodiment of the bucket of the present invention wherein the "F" letter represents the front view, "T" the rear view; "D" the right view: and "I" the left view.
Figure 11:
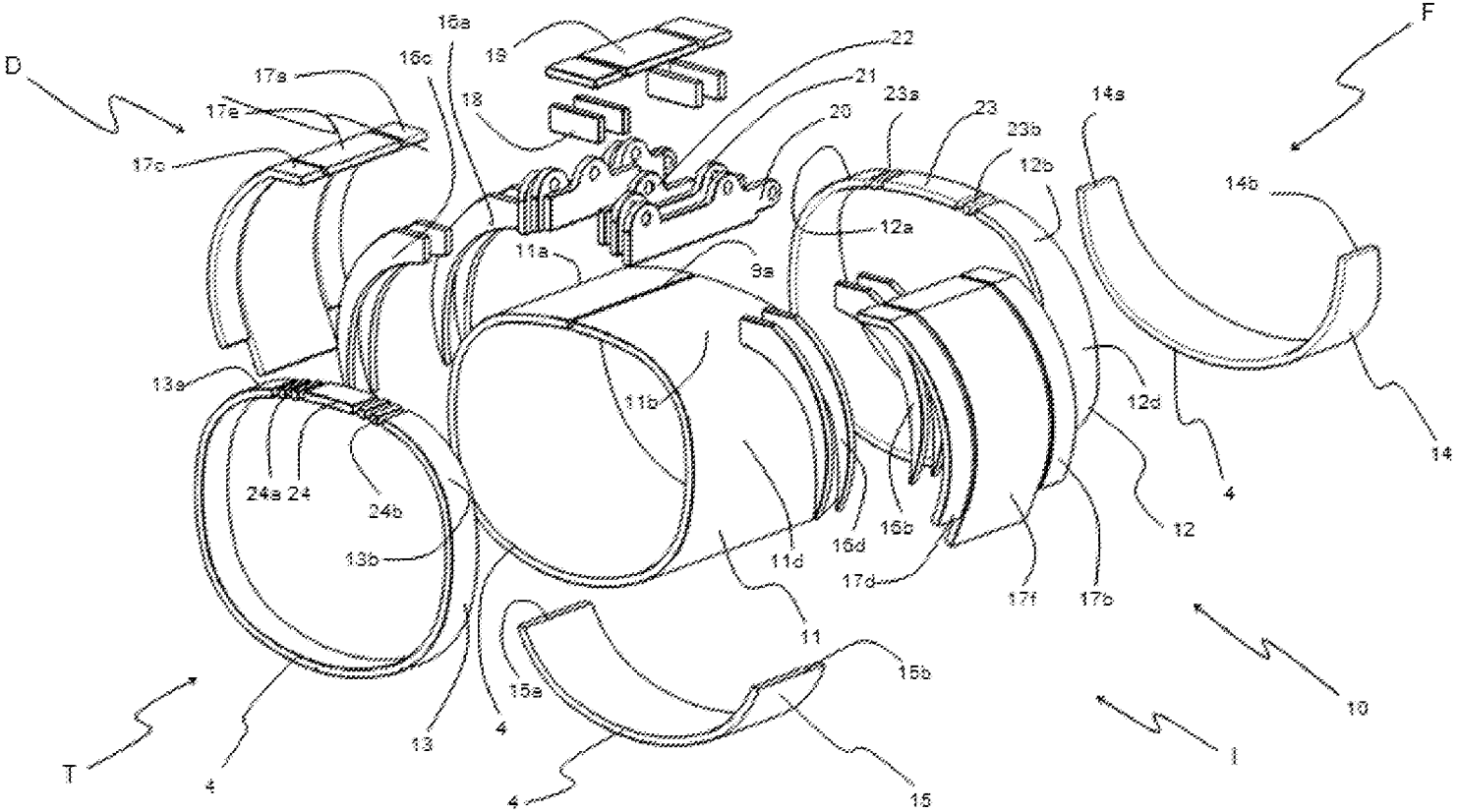
FIG. 11 shows a back exploded perspective view of the components of a second embodiment of the bucket of the present invention wherein the "F" letter represents the front view, "T" the rear view; "D" the right view: and "I" the left view.
Figure 12:
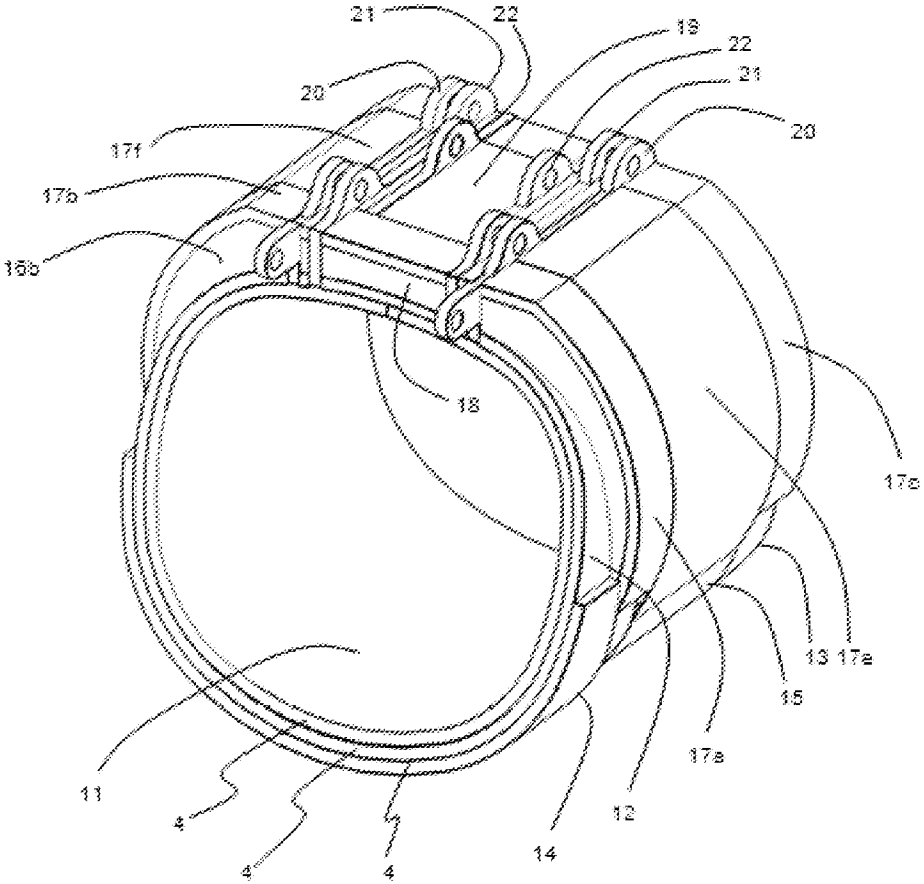
FIG. 12 shows a perspective view of a second embodiment of a bucket of the present invention.
Figure 13:
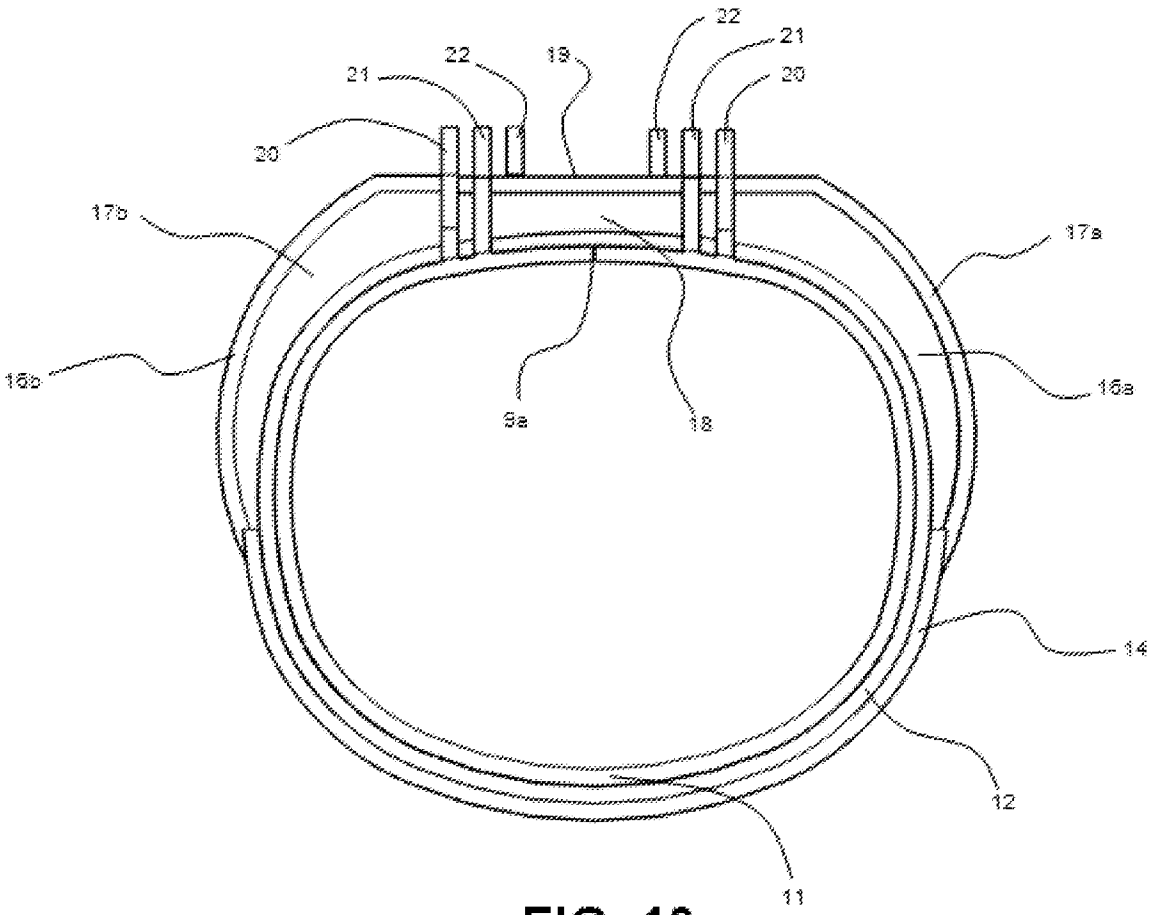
FIG. 13 shows an elevation front view of a second embodiment of a bucket of the present invention.
Figure 14:
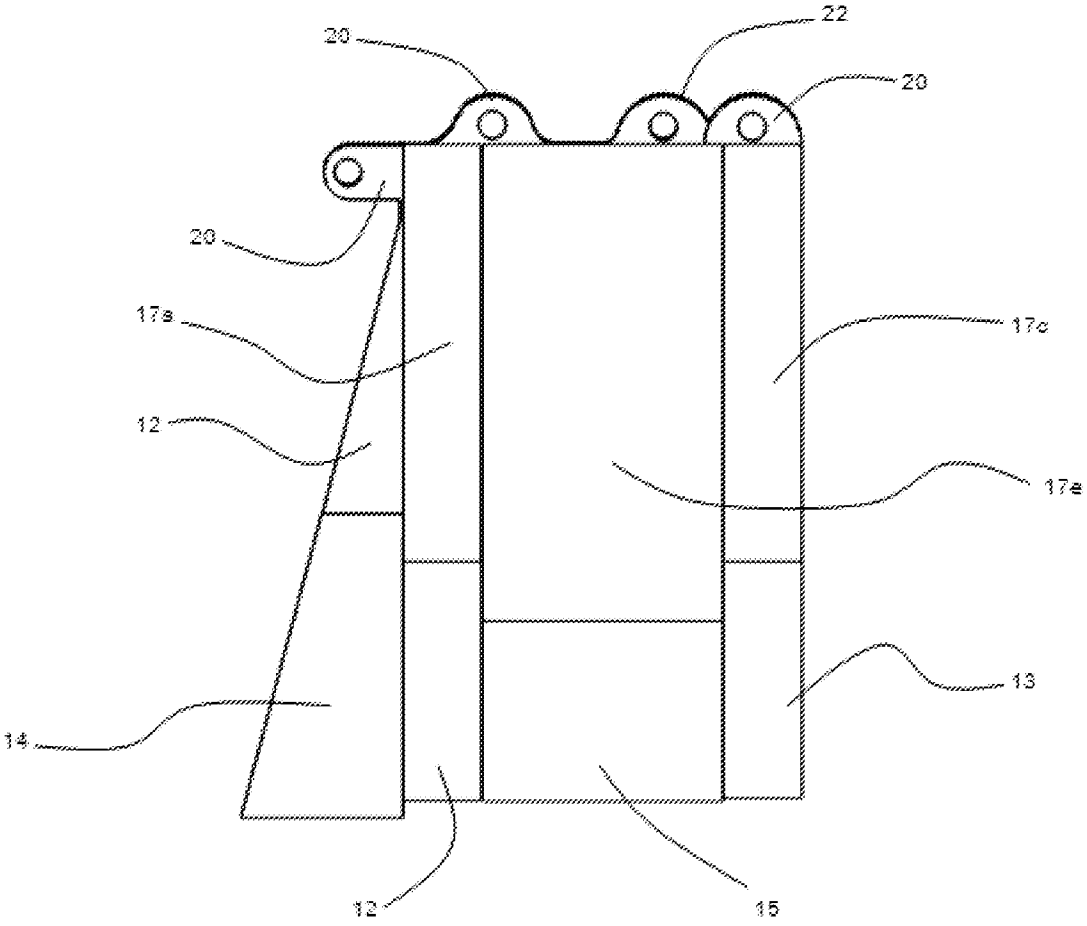
FIG. 14 shows a side view of a second embodiment of a bucket of the present invention.

FIG. 4*c* shows a higher resistance piece (7) made by means of a continuous folding having a closed curvature (8) on which lower part a first reinforcement piece (1*a*) and a second reinforcement piece (1*b*) are located, both pieces (7, 1*a*, 1*b*) being placed in a nested way, which are connected by a weld bead of higher joint (9*a*), multiple perimeter weld beads (9*b*), multiple longitudinal weld beads (9*d*) and multiple weld plugs (9*c*) where also said pieces (7, 1*a*, 1*b*) are each formed by a solid assembly of cold-bent plates (4).

The present invention proposes the construction of a bucket (10) for an excavator shovel for instance a rope shovel (dipper) wherein the body (10) in formed in a tubular way leaving in its interior a closed curvature (8) wherein said body is formed by at least one plate (4) which is folded until its ends are butted, requiring a single weld bead (9*a*) in order to form said body (11) in a tubular way.

Said body having in its exterior a plurality of reinforcement layers (12, 13, 14, 15) which are constituted by at least a plate (4). In the front lower portion of the body (8) is present the lip (25) which is formed by a plurality of sheets (25*a*, 25*b*, 25*c*, 25*d*) overlapped and nested, each sheet being formed by at least one plate (4). In the upper portion of the body (11) engagement means (20, 21, 22) are placed which are also made of at least one plate (4).

One of the embodiments of this invention is shown in FIGS. 5 to 9 wherein the bucket (10) comprises a body (11) which is constituted by at least one plate (4), being folded in a tubular way, thereby forming the upper wall, the lower wall and the side walls wherein said folding is made until the ends of said at least one plate (4) are butted, which are joined by means of a weld bead (9*a*).

On the front outer surface of said body (11) a front perimeter reinforcement (12) is mounted which is constituted by at least one plate (4) which is folded following the front outer outline of the body (11) until its right upper edge (12*a*) is in contact (abutment) with its left upper edge (11*a*) of the outer body surface (11) and until its left upper edge (12*b*) is in contact (abutment) with the left upper edge (11*b*) of the outer body surface (11).

The central upper portion of the front perimeter reinforcement (12) has separated portions (23) comprising first front right slots (23*a*) and second front left slots (23*b*) which are provided to house the pivoting engagement supports (20, 21).

On the back outer surface of said body (11) an rear perimeter reinforcement (13) is mounted which is constituted by at least one plate (4) which is folded following the front outer outline of the body (11) until its right upper edge (13*a*) is in contact with (abutment) its right upper edge (11*a*) of the outer body surface (11) and until its left upper edge (13*b*) is in contact (abutment) with the left upper edge (11*b*) of the outer body surface (11). The center upper part of the rear perimeter reinforcement (13) has separated portions (24) which comprise first right rear slots (24*a*) and second left rear slots (24*b*) which are provided to house the engagement supports (20, 21) and the break support (22).

Below the lower center outer surface of said body (11) a wear reinforcement (15) is mounted which is constituted by at least one plate (4) which is folded following the lower outer outline of the body (11) until its right upper edge (15*a*) is in contact (abutment) with its right middle edge (11*c*) of the outer body surface (11) and until its left upper edge (15*b*) is in contact (abutment) with the left middle edge (11*d*) of the outer body surface (11) wherein said right and left middle edges (11*c*, 11*d*) are located at approximately half height of the body (11).

Below the lower outer front surface of said front perimeter reinforcement (12) a lip reinforcement (14) is mounted which is constituted by at least one plate (4) which is folded following the lower outer outline of the front perimeter reinforcement (12) until its right upper edge (14*a*) is in contact (abutment) with its right middle edge (12*c*) of the outer surface of the front perimeter reinforcement (12) and until its left upper edge (14*b*) is in contact (abutment) with the left middle edge (12*d*) of the outer surface of the front perimeter reinforcement (12) wherein said right, left and middle edges (12*c*, 12*d*) are located at approximately half height of the front perimeter reinforcement (12).

On the right side outer surface and right upper surface of said front perimeter reinforcement (12) is mounted a plurality of first side right ribs as transverse reinforcements (16*a*) which are constituted by at least one plate (4).

These first side right ribs as transverse reinforcements (16*a*) are straight and its lower outline is cut following the right side outline of the right upper half of the front perimeter reinforcement (12) and the outline of the right upper edge (12*a*) until they are slightly extended on the upper outer right surface of the front perimeter reinforcement (12).

The upper outline of the first side right ribs as transverse reinforcements (16*a*) is cut to support at least one first front right side cover (17*a*) which laterally wraps the front perimeter reinforcement (12) on the right side and at the same time, it wraps the upper right portion of said front perimeter reinforcement (12).

Said at least one first front right side cover (17*a*) is constituted by at least one plate (4) and folded following the upper outline of the first side right ribs as transverse reinforcements (16*a*).

On the left side outer surface and left upper surface of said front perimeter reinforcement (12) is mounted a plurality of second side left ribs (16*b*) as transverse reinforcements (16*a*) which are constituted by at least one plate (4).

These second side left ribs as transverse reinforcements (16*b*) are straight and its lower outline is cut following the left side outline of the left upper half of the front perimeter reinforcement (12) and the outline of the left upper edge (12*b*) until they are slightly extended on the upper outer left surface of the front perimeter reinforcement (12).

The upper outline of second side left ribs as transverse reinforcements (16*b*) is cut to support al least one second front left side cover (17*b*) which laterally wraps the front perimeter reinforcement (12) on the left side and at the same time it wraps the upper left portion of said front perimeter reinforcement (12).

Said at least one second front left side cover (17*b*) is constituted by at least one plate (4) and folded following the upper outline of the second side left ribs as transverse reinforcements (16*b*).

On the right side outer surface and right upper surface of said rear perimeter reinforcement (13) is mounted a plurality of first side right ribs as transverse reinforcements (16*c*) which are constituted by at least one plate (4).

These first side right ribs as transverse reinforcements (16*c*) are straight and its lower outline is cut following the right side outline of the right upper half of the rear perimeter reinforcement (13) and the outline of the right upper edge (13*a*) until they are slightly extended on the upper outer right surface of the rear perimeter reinforcement (13).

The upper outline of the first side right ribs as transverse reinforcements (16*c*) is cut to support at least one first back right side cover (17*c*) which laterally wraps the rear perimeter reinforcement (13) on the right side and at the same time, it wraps the center right portion of said rear perimeter reinforcement (13).

Said at least one first rear right side cover (17*c*) is constituted by at least one plate (4) and folded following the upper outline of the first side right ribs as transverse reinforcements (16*c*).

On the left side outer surface and left upper surface of said rear perimeter reinforcement (13) is mounted a plurality of second side left ribs as transverse reinforcements (16*d*) which are constituted by at least one plate (4).

These second side left ribs as transverse reinforcements (16*d*) are straight and its lower outline is cut following the left side outline of the left upper half of the rear perimeter reinforcement (13) and the outline of the left upper edge (13*b*) until they are slightly extended on the upper outer left surface of the rear perimeter reinforcement (13).

The upper outline of second side left ribs as transverse reinforcements (16*d*) is cut to support al least one second back left side cover (17*d*) which laterally wraps the rear perimeter reinforcement (13) on the left side and at the same time it wraps the center left portion of said rear perimeter reinforcement (13).

Said at least one second back left side cover (17*d*) is constituted by at least one plate (4) and folded following the upper outline of the second side left ribs as transverse reinforcements (16*d*).

Between said at least one first front side right cover (17*a*) and said at least one first back side right cover (17*c*) a center right cover (17*e*) is mounted. Between said at least one second front side left cover (17*b*) and said at least one second back side left cover (17*d*) a center left cover (17*f*) is mounted.

On the upper surface of said body (11) near to the side edge are mounted: a first pair of engagement supports (20) which are constituted by at least a plate (4) and a second pair of engagement supports (21) which are also constituted by at least one plate (4).

These first and second pairs of engagement supports (20, 21) are located on the upper surface of the body (11). At each side of said first and second engagement support pairs (20, 21) and towards the center of the upper surface of said body (11) are mounted a pair of break supports for the cover (22). Said pair of break supports for the cover (22) is also constituted by the at least one plate (4). The cover of the bucket (10) that is mounted on the rear part is not shown in the drawings.

Among said first and second pairs of engagement support (20, 21) and said pair of break supports (22) a plurality of upper transverse ribs (18) are mounted, which are a continuation of the side ribs as transverse reinforcement (16*a*, 16*b*, 16*c*, 16*d*) on which a plurality of upper covers (19), which is a continuation of the plurality of side covers (17*a*, 17*b*, 17*c*, 17*d*, 17*e*, 17*f*) is mounted.

Both the plurality of transverse upper ribs (18) and the plurality of upper covers (19) are constituted by at least one plate (4).

In a first embodiment, according to FIGS. 5 to 9, the body (11) of the bucket (10) has a front perimeter of rectangular shape.

However, in other preferred embodiment of the present invention, according to FIGS. 10 to 14, the body (11) of the bucket (10) has a front perimeter of elliptical shape.

The front lower portion of the buckets in the previous art is provided with a lip on which the excavation teeth (gets) are engaged.

Figure 15:
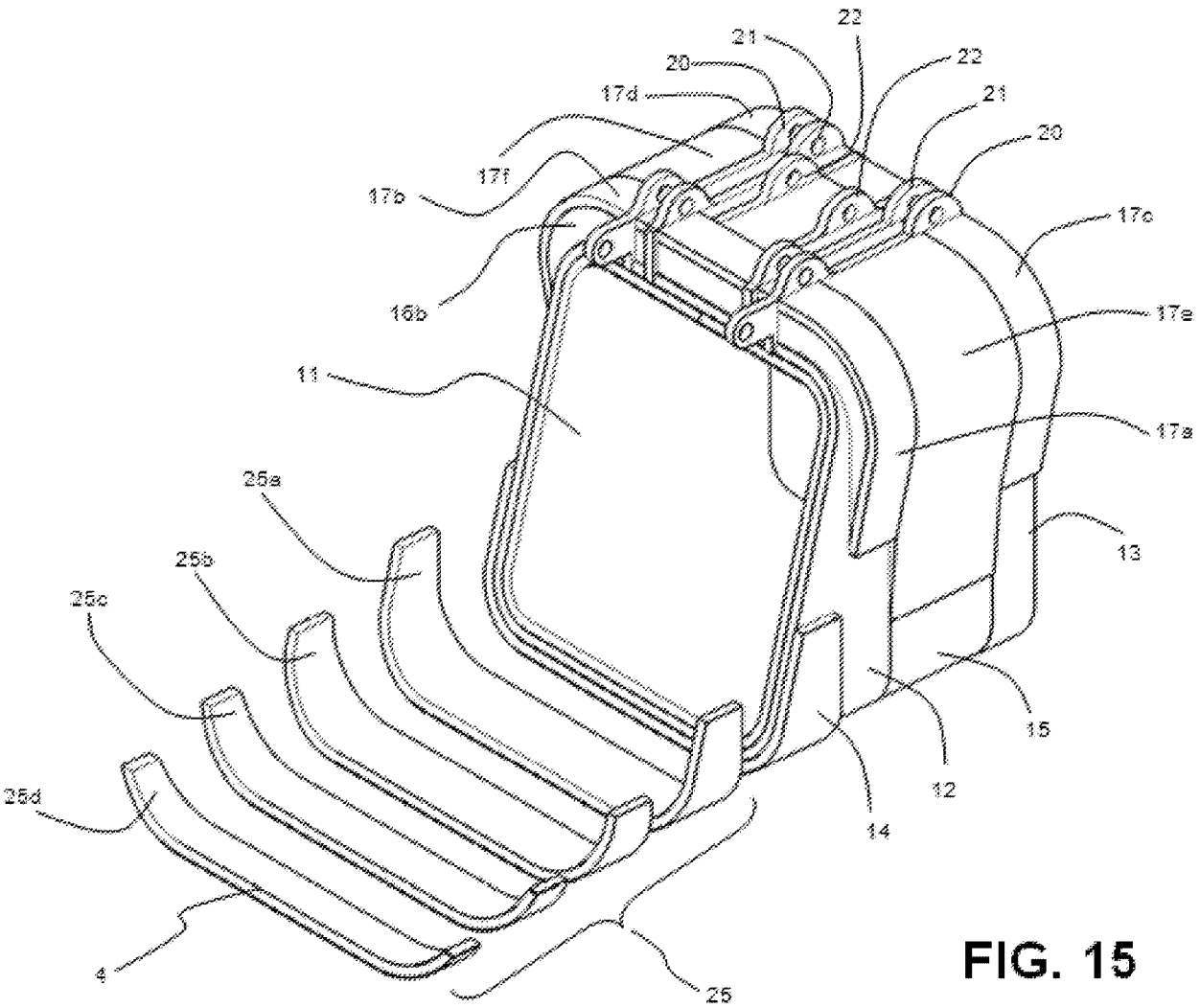
FIG. 15 shows a perspective view of a first embodiment of a bucket of the present invention wherein the components of the lip are showed in an exploded view.
Figure 16:
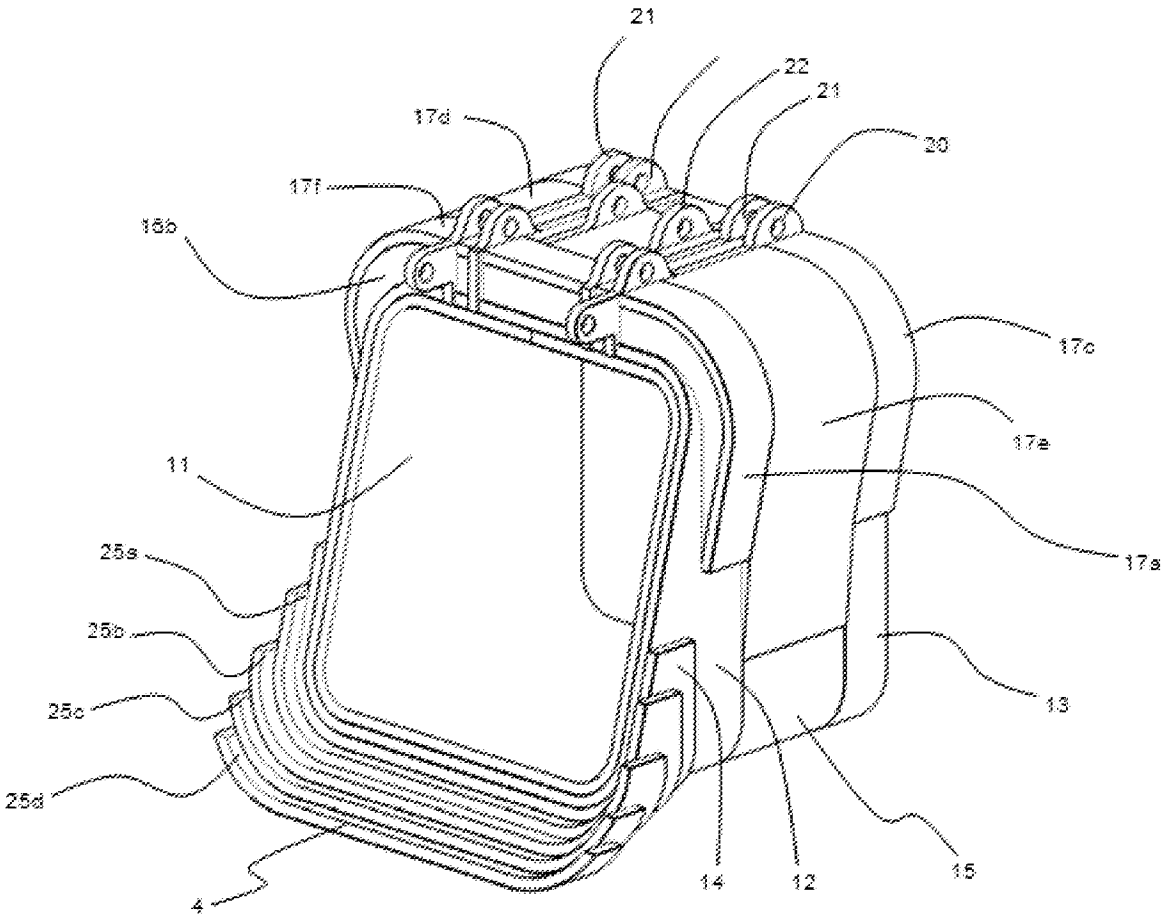
FIG. 16 shows a perspective view of a first embodiment of a bucket of the present invention wherein the lip construction is showed.
Figure 17:
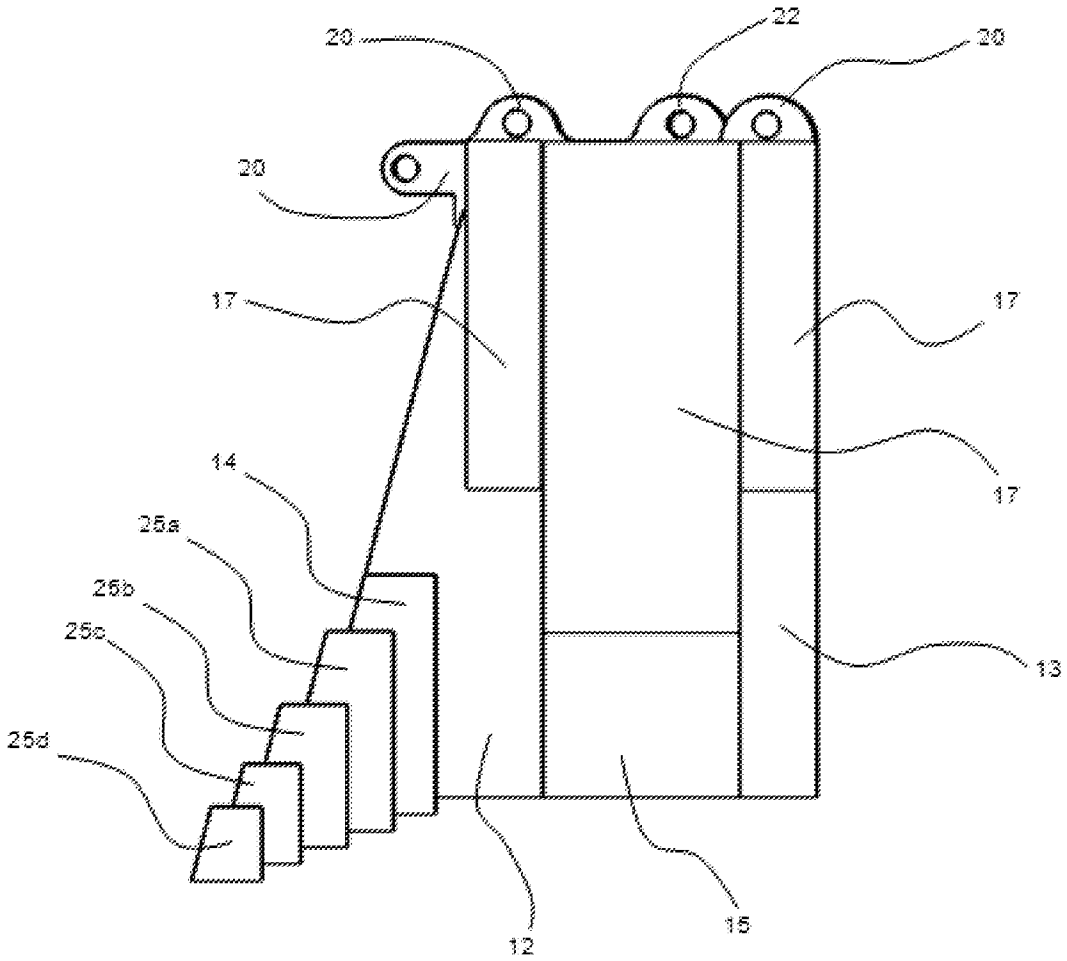
FIG. 17 shows a side view of a first embodiment of a bucket of the present invention wherein the lip construction is showed.

The present invention also proposes a solution of forming said lip. Thus, according to FIGS. 15 to 17, the lip is formed by multiple nested sheets (25) which are constituted by at least one plate (4).

A first nested sheet (25*a*) follows the lower outline of the lip reinforcement (14), being slightly overlapped towards the front portion of said lip reinforcement (14).

A second nested sheet (25*b*) follows the lower outline of the first nested sheet (25*a*) being slightly overlapped towards the front portion of said first nested sheet (25*a*). A third nested sheet (25*c*) follows the lower outline of the second nested sheet (25*b*) being slightly overlapped towards the front portion of said second nested sheet (25*b*). A forth nested sheet (25*d*) follows the lower outline of the third nested sheet (25*c*) being slightly overlapped towards the front portion of said third nested sheet (25*c*).

The multiple nested sheets (25) which are used to form the lip of the bucket (10) will depend on the thickness of said lip as designed for each case.

The invention claimed is:

1. A bucket for a rope shovel providing a resistant structure CHARACTERIZED in that said bucket comprises a tubular body (11) having an interior with a closed curvature (8), wherein said tubular body (11) includes a plurality of laminated steel plates having butted ends and weld beads (9*a*, 9*b*, 9*c*) and/or weld plugs (9*c*), said tubular body (11) having in its exterior with a plurality of reinforcement layers (12, 13, 14, 15) comprising a plurality of other laminated steel plates, said tubular body (11) having a front lower portion with a lip (25) comprising a plurality of overlapped and nested sheets (25*a*, 25*b*, 25*c*, 25*d*), each of said overlapped and nested sheets (25*a*, 25*b*, 25*c*, 25*d*) comprising a plurality of further laminated steel plates, and said tubular body (11) having an upper portion with engagement supports (20, 21, 22) comprising a plurality of more laminated steel plates.

2. The bucket for a rope shovel as claimed in claim 1, CHARACTERIZED in that said plurality of reinforcement layers (12, 13, 14, 15) comprise a front perimeter reinforcement (12), a rear perimeter reinforcement (13), a lip reinforcement (14), and a wear reinforcement (15).

3. The bucket for a rope shovel as claimed in claim 2, CHARACTERIZED in that said front perimeter reinforcement (12) has a front lower outer surface with front perimeter reinforcement-middle edges (12*c*, 12*d*), and said lip reinforcement (14) is positioned below said front lower outer surface of said front perimeter reinforcement (12) and has lip reinforcement upper edges (14*a*, 14*b*) positioned in abutment with said middle edges (12*c*, 12*d*) of said front lower outer surface of the front perimeter reinforcement (12), and wherein said front perimeter reinforcement middle edges (12*c*, 12*d*) are located at approximately half height of said front perimeter reinforcement (12).

4. The bucket for a rope shovel as claimed in claim 3, CHARACTERIZED in that said overlapped and nested sheets (25) comprise: a first nested sheet (25*a*), a second nested sheet (25*b*), a third nested sheet (25*c*), and a fourth nested sheet (25*d*).

5. The bucket for a rope shovel as claimed in claim 4, CHARACTERIZED in that said tubular body (11) has a tubular body-outer surface and tubular body-upper edges (11*a*, 11*b*), and said front perimeter reinforcement (12) is positioned on said tubular body-outer surface and has front perimeter reinforcement-upper edges (12*a*, 12*b*) positioned in abutment with said tubular body-upper edges (11*a*, 11*b*) of said tubular body-outer surface of said tubular body (11).

6. The bucket for the rope shovel as claimed in claim 5, CHARACTERIZED in that said rear perimeter reinforcement (13) has an upper center part with separated portions (24) defining first right rear slots (24*a*) and second left rear slots (24*b*) to receive and house said engagement supports (20, 21).

7. The bucket for a rope shovel as claimed in claim 6, CHARACTERIZED in that said tubular body has tubular body-middle edges (11*c*, 11*d*), and said wear reinforcement (15) is positioned below said tubular body outer surface of said tubular body (11) and has wear reinforcement-upper edges (15*a*, 15*b*) in abutment with said tubular body-middle edges (11*c*, 11*d*), and wherein said tubular body-middle edges (11*c*, 11*d*) are located at approximately half height of said tubular body (11).

8. The bucket for a rope shovel as claimed in claim 7 CHARACTERIZED in that said front perimeter reinforcement (12) has a right side portion and an upper right portion with a plurality of first side right front ribs providing first transverse reinforcements (16*a*) covered by at least one first front side right cover (17*a*); and said front perimeter reinforcement (12) has a left side portion and a left upper portion with a plurality of second side left front ribs providing second transverse reinforcements (16*b*) covered by at least one second front side left cover (17*b*).

9. The bucket for a rope shovel as claimed in claim 8, CHARACTERIZED in that said rear perimeter reinforcement (13) has a plurality of first side right rear ribs providing third transverse reinforcements (16*c*) covered by at least one first rear side right cover (17*c*) and said rear perimeter reinforcement (13) has a plurality of second side left rear ribs providing fourth transverse reinforcements (16*d*) covered by at least one second rear side left cover (17*d*).

10. The bucket for a rope shovel as claimed in claim 9, CHARACTERIZED in that between said at least one first front side right cover (17*a*) and said at least one first rear side right cover (17*c*) is positioned a center right cover (17*e*); and between said at least one second front side left cover (17*b*) and said at least one second back side left cover (17*d*) is positioned a center left cover (17*f*).

11. The bucket for a rope shovel as claimed in claim 10, CHARACTERIZED in that said tubular body (11) has an upper center portion with a plurality of transverse upper ribs (18) and a plurality of upper covers (19).

12. The bucket for the rope shovel as claimed in claim 11, CHARACTERIZED in that said front perimeter reinforcement (12) has an upper center part defining separated portions (23) comprising first right front slots (23*a*) and second left front slots (23*b*) to receive and house said engagement supports (20, 21).

13. The bucket for a rope shovel as claimed in claim 12, CHARACTERIZED in that said tubular body (11) has an outer rear surface and said rear perimeter reinforcement (13) is positioned on said outer rear surface of said tubular body (11) and has rear perimeter reinforcement-upper edges (13*a*, 13*b*) in abutment with said tubular body-upper edges (11*a*, 11*b*) of said tubular body (11).

14. The bucket for a rope shovel as claimed in claim 13, CHARACTERIZED in that said engagement supports comprise a first pair of engagement supports (20) and a second pair of engagement supports (21).

15. The bucket for a rope shovel as claimed in claim 14, CHARACTERIZED in that said engagement supports further comprise a pair of break supports (22) positioned along each side of said first pair of engagement supports (20) and second pair of engagement supports (21).

16. The bucket for the rope shovel as claimed in claim 15, CHARACTERIZED in that at least some of said transverse upper ribs (18) are positioned in proximity to said first and second pairs of engagement supports (20, 21) and said pair of break supports (22).

17. The bucket for a rope shovel as claimed in claim 1, CHARACTERIZED in that said tubular body (11) has a front perimeter with a rectangular shape.

18. The bucket for a rope shovel as claimed in claim 1, CHARACTERIZED in that said tubular body (11) has a front perimeter with an elliptical shape.

* * * * *